US011346165B2

(12) United States Patent
Rus

(10) Patent No.: US 11,346,165 B2
(45) Date of Patent: May 31, 2022

(54) HORIZONTAL STAND BUILDER AND CATWALK

(71) Applicant: Gustaaf Rus, Spruce Grove (CA)

(72) Inventor: Gustaaf Rus, Spruce Grove (CA)

( * ) Notice: Subject to any disclaimer, the term of this patent is extended or adjusted under 35 U.S.C. 154(b) by 0 days.

(21) Appl. No.: 16/924,554

(22) Filed: Jul. 9, 2020

(65) Prior Publication Data

US 2021/0010335 A1 Jan. 14, 2021

Related U.S. Application Data

(60) Provisional application No. 62/872,398, filed on Jul. 10, 2019.

(51) Int. Cl.
*E21B 19/15* (2006.01)
*E21B 19/06* (2006.01)
*E21B 19/16* (2006.01)

(52) U.S. Cl.
CPC ..... *E21B 19/155* (2013.01); *E21B 19/06* (2013.01); *E21B 19/161* (2013.01)

(58) Field of Classification Search
CPC ..... E21B 19/14; E21B 19/16; E21B 19/155; E21B 19/06; E21B 19/161; E21B 19/15; E21B 19/20; B23P 19/061; Y10T 82/2514; Y10T 408/381; B23Q 1/76; B23Q 7/003; B23Q 7/042; B23G 1/22; B23G 1/52; Y10S 470/901
See application file for complete search history.

(56) References Cited

U.S. PATENT DOCUMENTS

| | | | | |
|---|---|---|---|---|
| 4,067,453 | A * | 1/1978 | Moller | E21B 19/155 175/85 |
| 7,992,646 | B2 | 8/2011 | Wright et al. | |
| 8,052,368 | B2 * | 11/2011 | Littlewood | E21B 19/14 414/22.52 |
| 8,215,417 | B2 | 7/2012 | Annaiyappa et al. | |
| 8,469,085 | B2 | 6/2013 | Orgeron | |
| 8,840,352 | B2 | 9/2014 | Taggart et al. | |
| 9,157,286 | B2 | 10/2015 | Richardson et al. | |
| 9,879,442 | B2 * | 1/2018 | Magnuson | E21B 19/12 |
| 10,060,202 | B2 | 8/2018 | Folk | |
| 10,060,203 | B2 | 8/2018 | Dore et al. | |
| 10,519,729 | B2 | 12/2019 | Jonah et al. | |
| 2002/0079105 | A1 * | 6/2002 | Bergeron | E21B 19/16 166/379 |
| 2007/0221385 | A1 | 9/2007 | Braun et al. | |
| 2016/0251916 | A1 | 9/2016 | Arbelaez et al. | |
| 2016/0356105 | A1 * | 12/2016 | Jonah | E21B 19/165 |
| 2017/0096867 | A1 * | 4/2017 | Folk | E21B 19/16 |

* cited by examiner

*Primary Examiner* — Gregory W Adams
(74) *Attorney, Agent, or Firm* — Bushman Werner, P.C.

(57) ABSTRACT

A system and method for horizontally building stands of tubulars and transferring them to a rig floor. The system has a horizontal stand builder which assembles double or triple stands of tubulars. A catwalk and V-door are positioned alongside the horizontal stand builder. A skate is able to push either single, double, or triple stands along the catwalk and up the V-door to a position whereby an elevator on the rig can grip the stand and move it onto the rig. For transferring single stands of tubular, there is a carrier at the upper end of the V-door which can grip the single stand and lift it to the position for the elevator to grip it and move it onto the rig.

19 Claims, 16 Drawing Sheets

HORIZONTAL STAND BUILDER AND CATWALK

CROSS REFERENCE TO RELATED APPLICATION

This application claims priority to U.S. Application No. 62/872,398 filed on Jul. 10, 2019, the disclosure of which is incorporated herein by reference for all purposes.

FIELD OF THE INVENTION

The present invention relates to horizontal tubular stand builder and catwalk and, more particularly, to a horizontal stand builder and catwalk for building and transferring triple stands of drill pipe or double stands of casing.

BACKGROUND OF THE INVENTION

A drill string is made up of individual pieces of drill pipe connected together. Generally, the drill string is made up while drilling occurs. The individual pieces of pipe are moved from a ground level rack up to the floor of the drilling rig using a catwalk and a hoist or elevator. The pipe is raised to a vertical position and positioned over the existing drill string and connected to the end thereof. Once the connection is sufficiently torqued or tightened, the drilling operation continues until it is time to add the next piece of pipe. Drill pipe is typically 30 feet in length so the frequency at which new pipe is added is high. This slows down the overall drilling process as drilling must cease while new pipe is added. Additionally, every time pipe is added presents risks to the workers and personnel who manually handle the pipe during the connection process. To improve efficiency, it has become common practice to preassemble two or three pieces of pipe to form stands, i.e., double stands or triple stands. This reduces the number of times drilling must be stopped to connect additional pipe to the drill string and reduces the risks to the workers. The present invention relates to a system for building triple stands of tubular (drill pipe or casing) and transferring it to the rig floor in a safe and efficient manner.

SUMMARY OF THE INVENTION

The present invention relates to a system for horizontally building double or triple stands of drill pipe and double stands of casing.

The present invention relates to a system for horizontally building double or triple stands of drill pipe and double stands of casing and transferring the stands to the floor of an oil rig.

The present invention relates to a catwalk system capable of transferring single, double, or triple stands of tubulars to floor of an oil rig.

The present invention relates to a method of horizontally building stands of tubulars and transferring them to the floor of an oil rig.

These and further features and advantages of the present invention will become apparent from the following detailed description, wherein reference is made to the figures in the accompanying drawings.

DETAILED DESCRIPTION OF PREFERRED EMBODIMENTS

As used herein, the term "tubular" includes pipe, casing, and any other elongate tubular structure which may be assembled and/or transferred using the system of the present invention.

Figure 1:
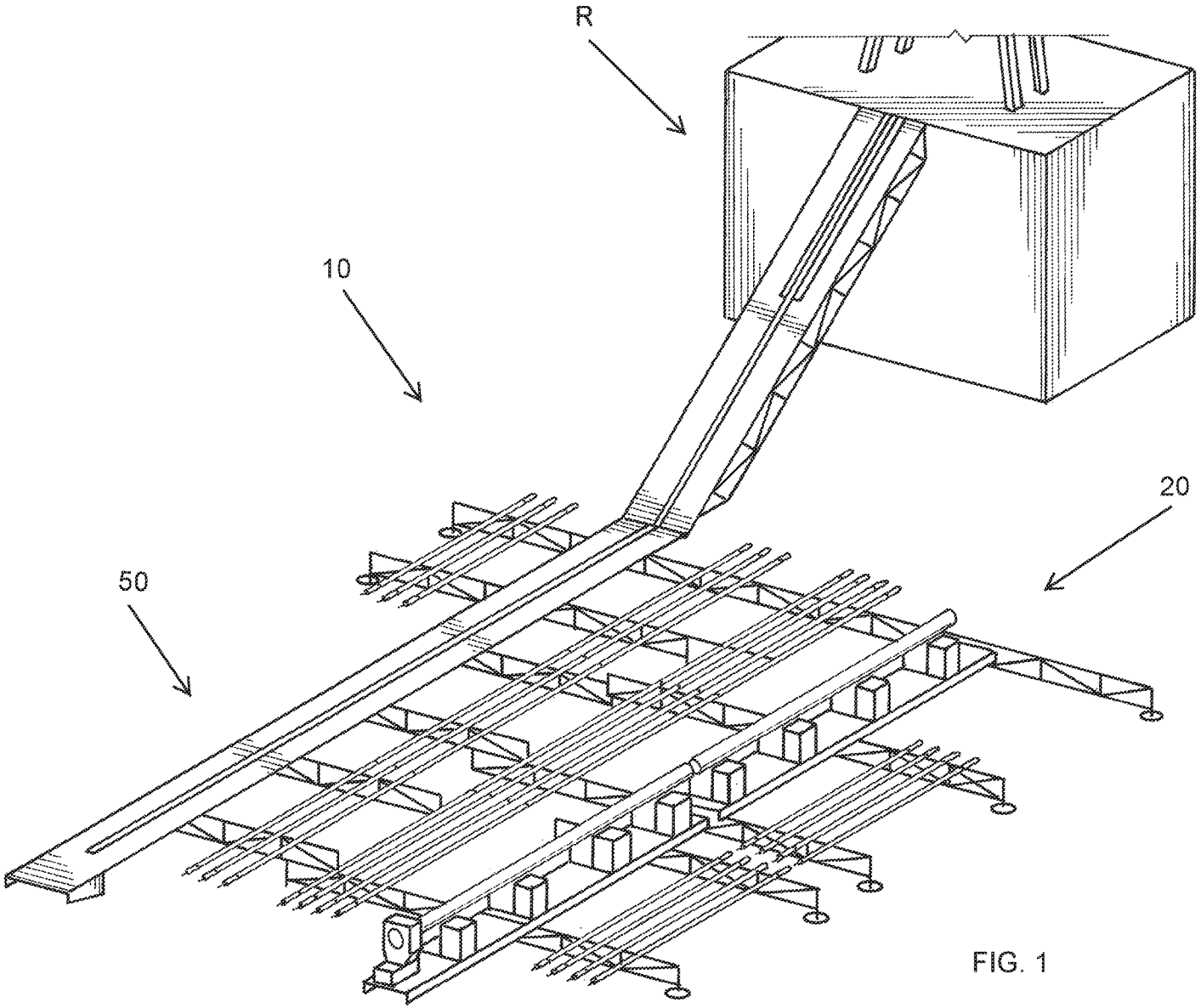
FIG. 1 is a perspective view of one embodiment of the horizontal stand builder and catwalk system of the present invention.

Turning to FIG. 1 there is shown generally as 10 the horizontal stand builder and catwalk system of the present invention. The system includes the horizontal stand builder, shown generally as 20, the catwalk shown generally as 50, and is depicted near alongside rig R.

Figure 2:
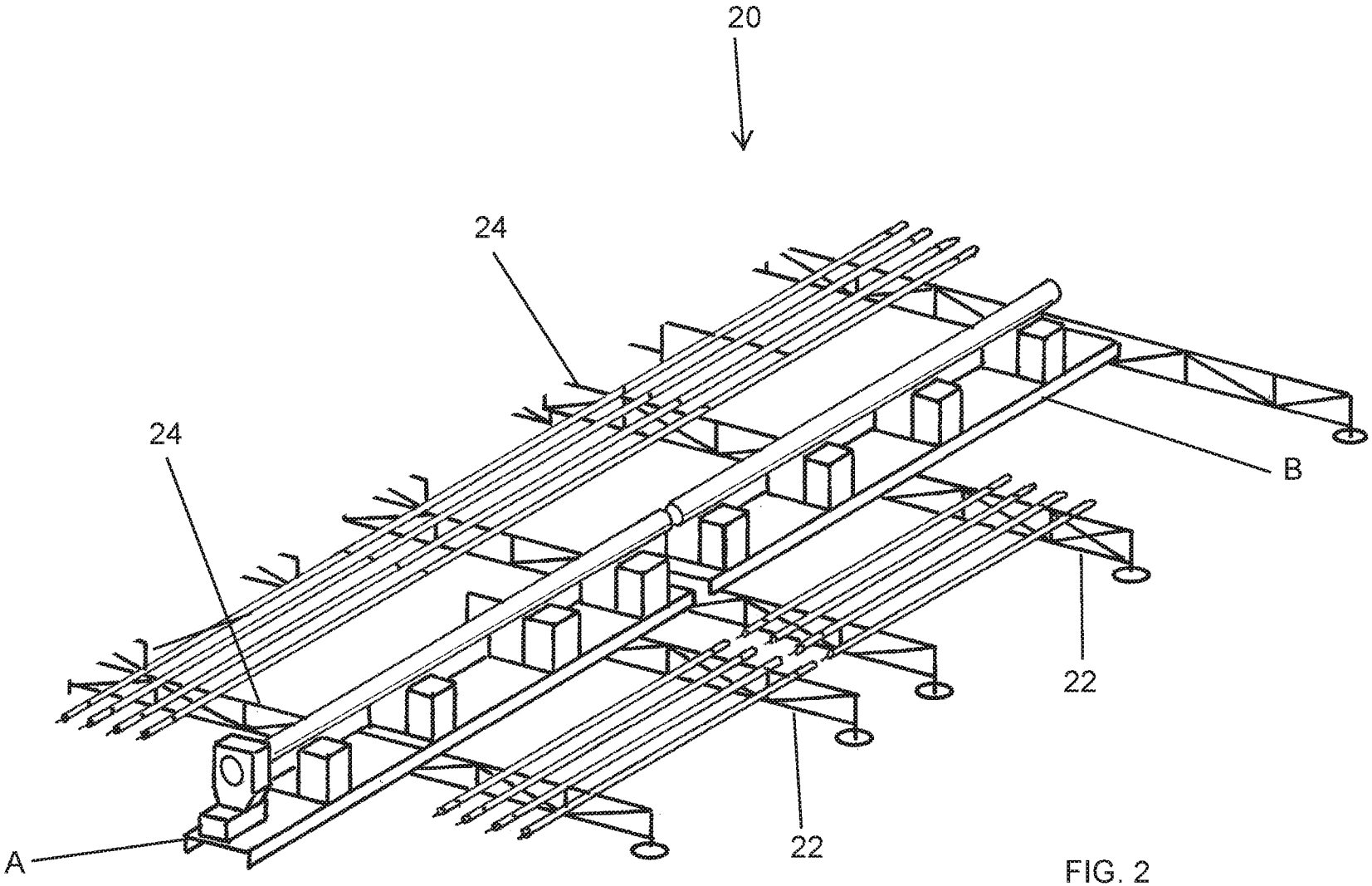
FIG. 2 is a perspective view of one embodiment of the stand builder of the present invention.
Figure 3:
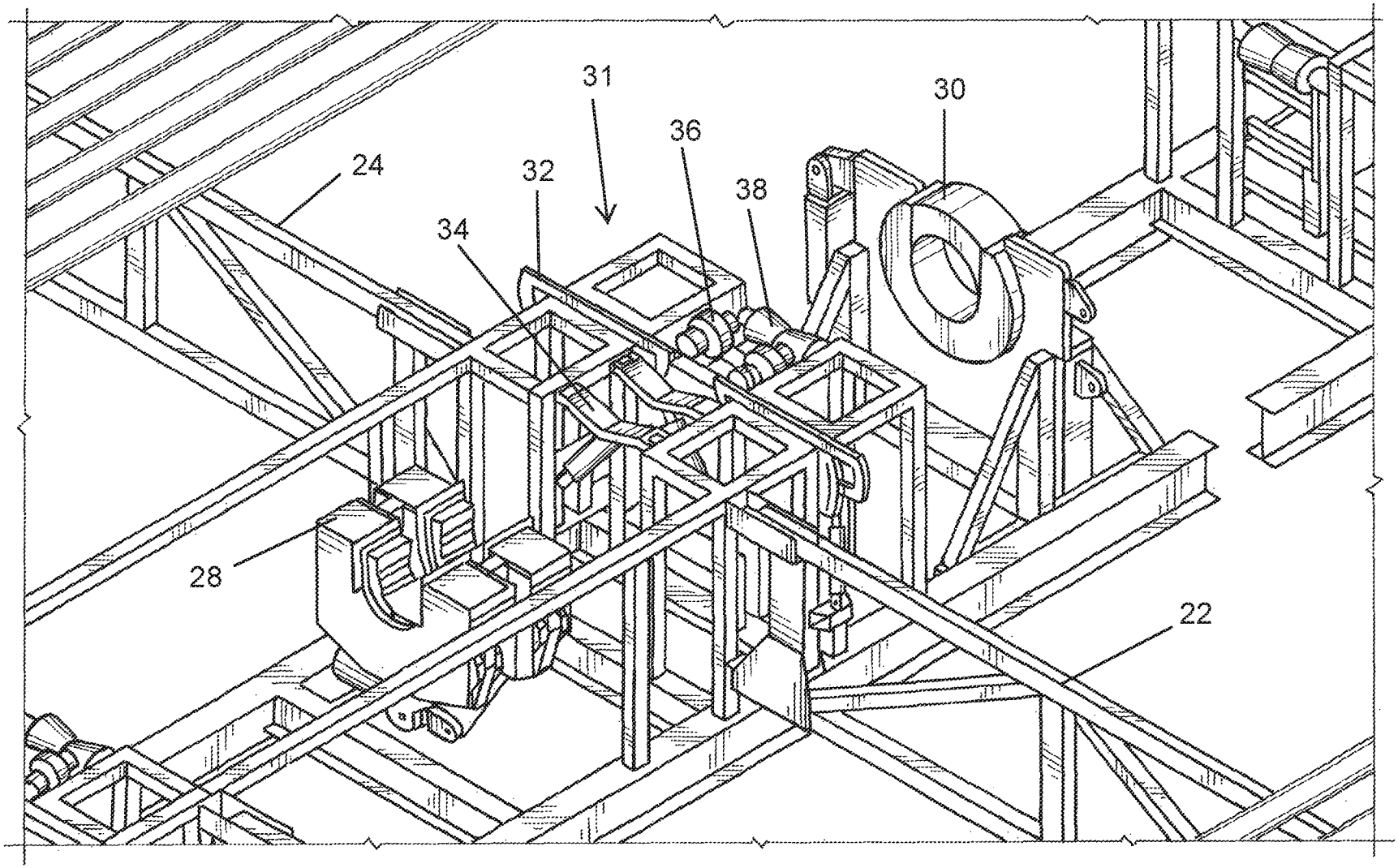
FIG. 3 is an enlarged view of a portion of stand builder of FIG. 2.
Figure 4:
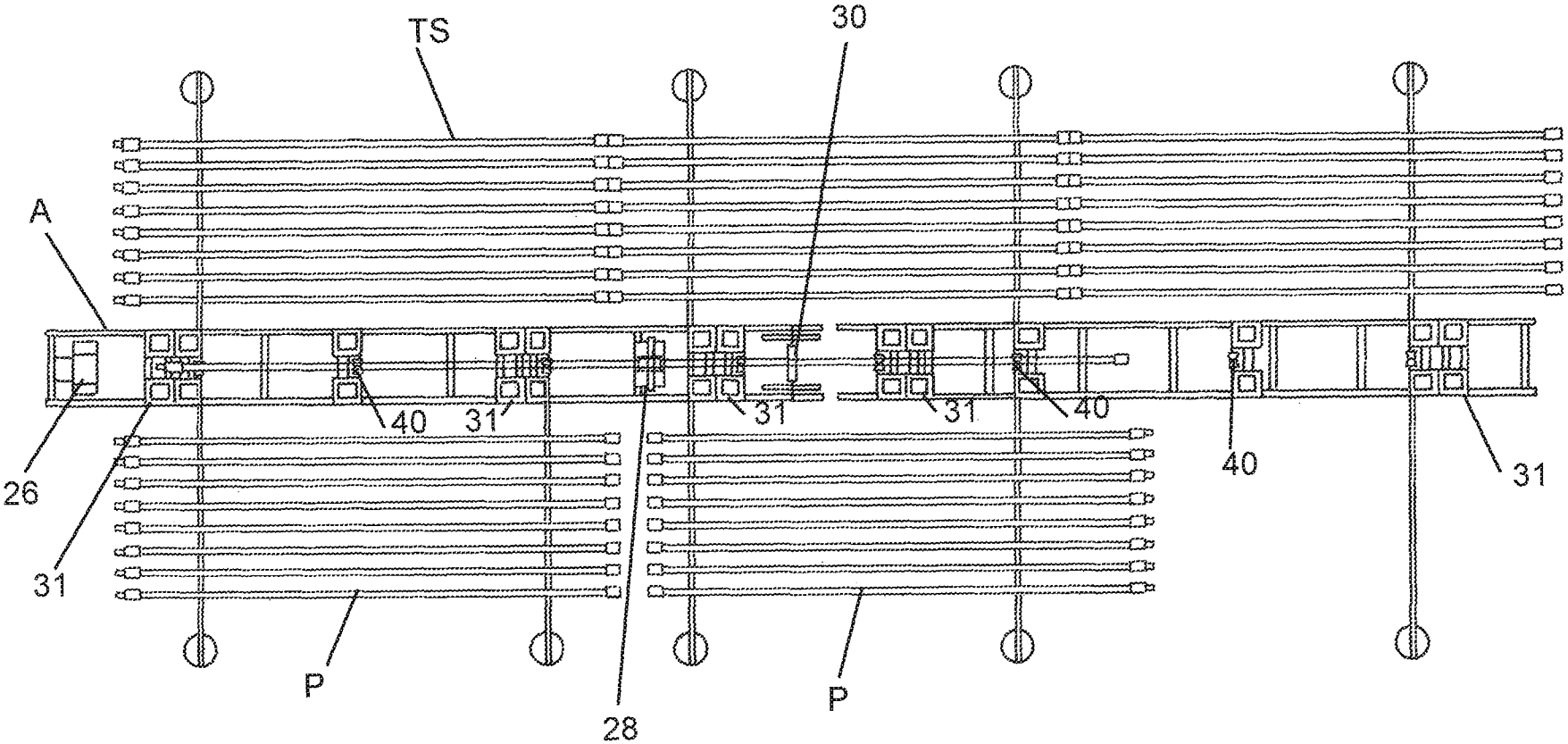
FIG. 4 is a plan view of the stand builder of FIG. 2.

Turning to FIGS. 2-4 there is shown one embodiment of the horizontal stand builder 20 of the present invention. It will be understood, and demonstrated hereafter, that while the stand builder is depicted with drill pipe, it can also be used to build stands of casing. One of skill in the art, will appreciate that drill pipe comes in different lengths, or ranges. Range 1 is about 18 to 22 feet long. Range 2 is about 27-30 feet long. Range 3 is about 38 to 45 feet long, the same as casing. Thus, a double stand of Range 3 pipe would be the same length as a double stand of casing. Racks 22 and 24 are positioned along opposite sides of stand builder 20. As depicted, stand builder 20 is made up of two skids, A and B, which allows for easier transport of the stand builder. Skid A is rearward (furthest from rig R) and includes casing power tongs 26, drill pipe power wrench 28, casing tongs 30, and multiple pipe handling units 31, which include pipe indexers 32, pipe kickers 34, pipe spinning rollers 36, and pipe horizontal lifting rollers 38. Skid B is forward (closest to rig R) and includes multiple pipe handling units 31. Both skids also include a plurality of idle rollers 40. As best seen in FIG. 4, single pieces of pipe P are positioned on racks 22. Made up triple pipe stands TS are positioned on racks 24.

Figure 5:
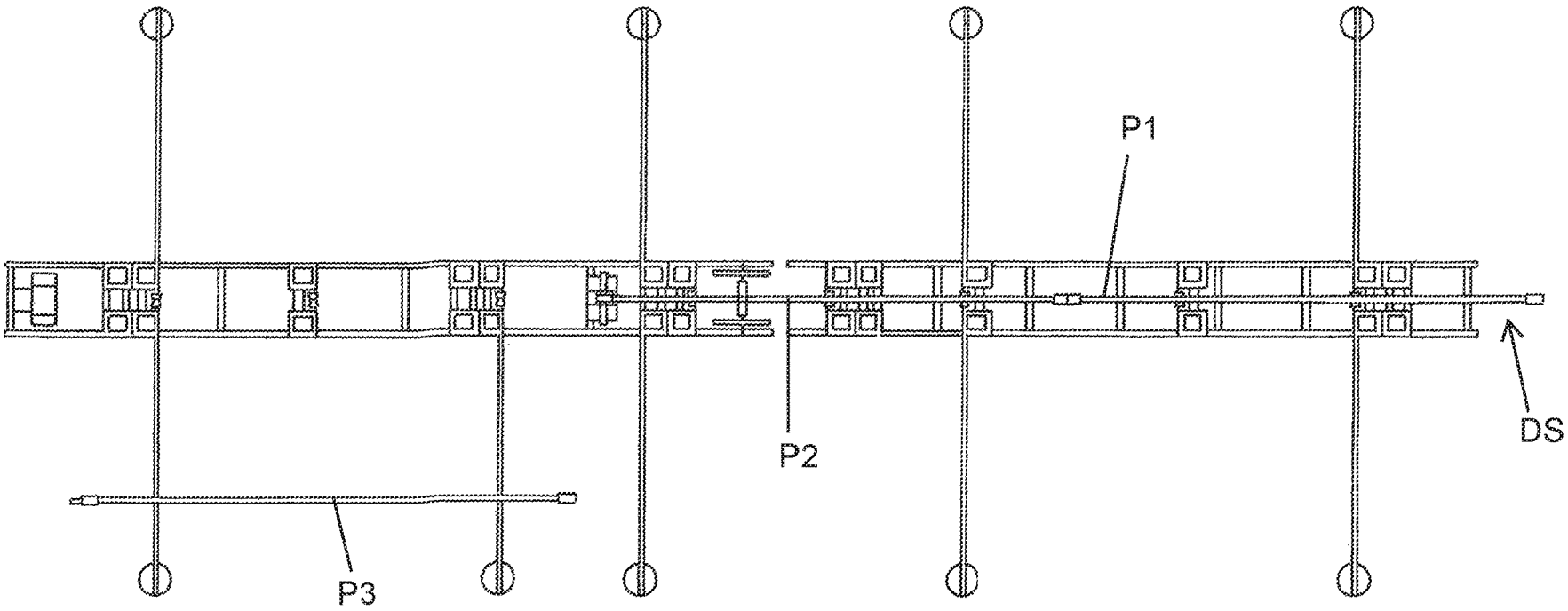
FIGS. 5-6 depict the building of a tripe stand of drill pipe on the stand builder of FIG. 2.
Figure 6:
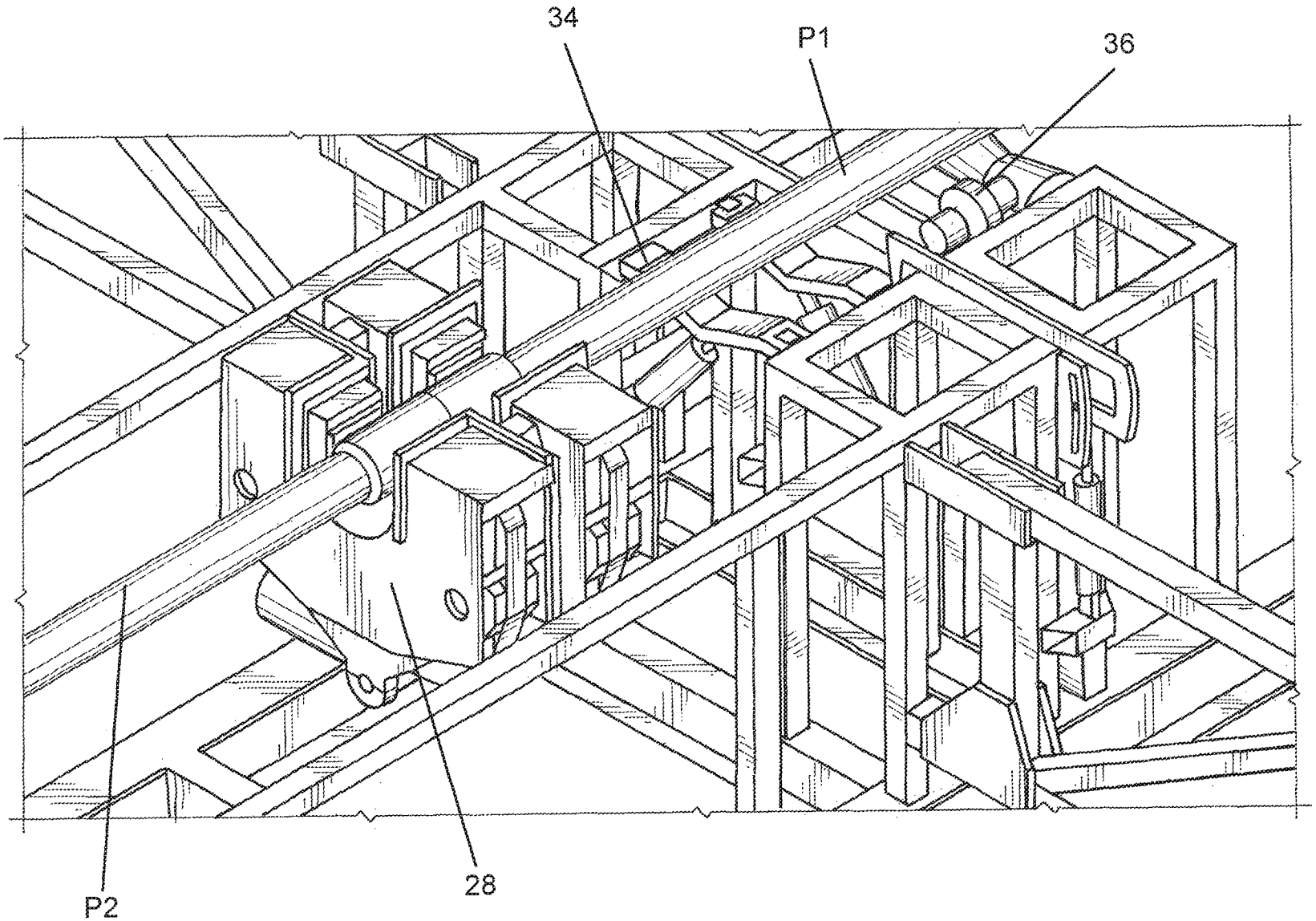

FIGS. 5-6 show the process of building a triple stand of drill pipe. The single stands of pipe P are positioned on racks 22. It is preferred to have twice as many pieces of pipe on the rear rack 22 as the number of pieces on the center rack. Two pieces of pipe, P1 from the center rack and P2 from the rear rack are moved onto the stand builder. The powered spinner rollers 36 and the power wrench 28 are used to make up the connection in a manner well known to those skilled in the art. The two pieces of pipe P are thus formed into a double stand DS (see FIG. 4). If a double stand of pipe is desired, the double stand DS can be moved off the stand builder 20 using kickers 34 to rack 24. Otherwise, to form a triple stand, double stand DS is moved forward to the front of the stand builder 20 and the final piece of pipe P3 is moved on to stand builder 20. Once again, power wrench 28 torques the connection in a well-known manner to connect pipe P3 and form triple stand TS. The pipe kickers 34 then move triple stand TS to racks 24.

Figure 7:
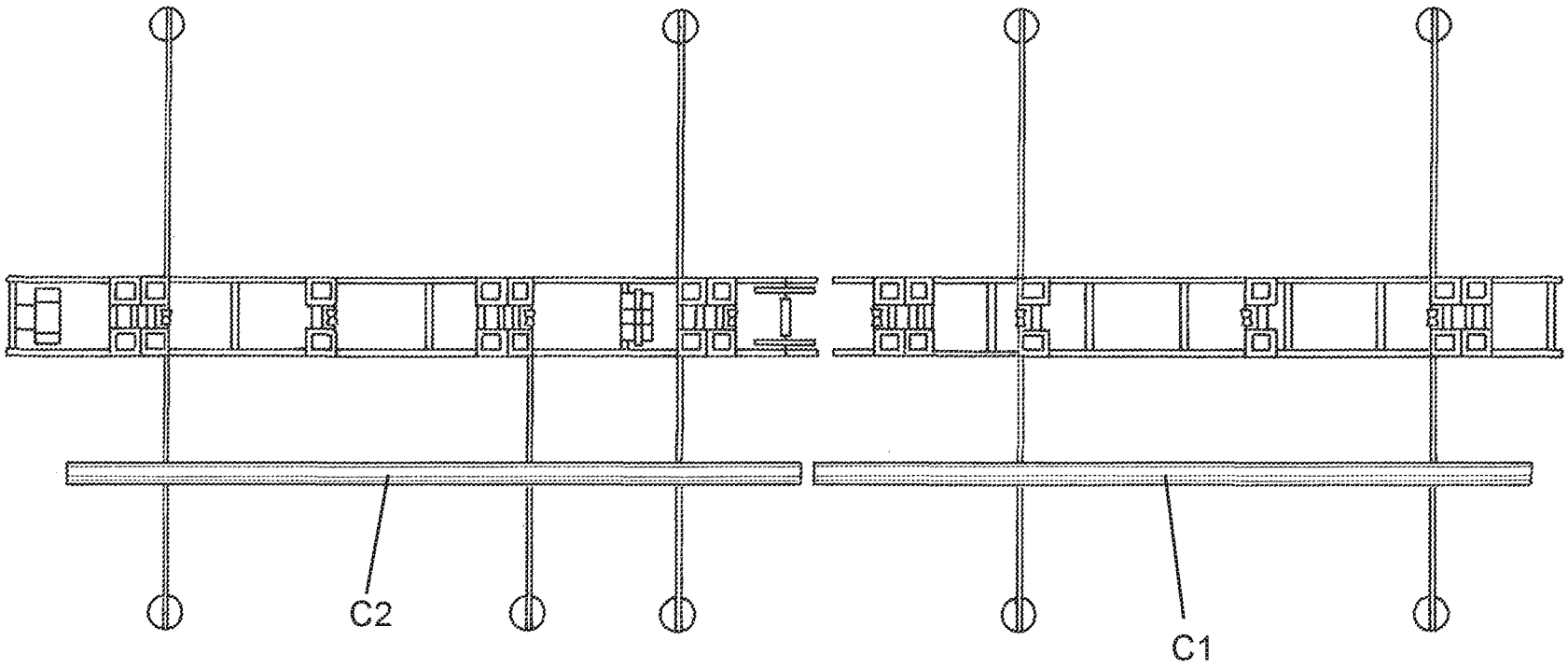
FIG. 7 depicts the building of a casing stand on the stand builder of FIG. 2.

FIG. 7 shows a similar process for building stands of casing. Casing however is longer than drill pipe and thus only double stands of casing are built. These are referred to herein as casing stands CS. Single pieces of casing C1 and C2 are positioned on racks 22. Casing pieces C1 and C2 are moved onto the stand builder. The casing power tongs 26 and the casing tongs 30 torque up the connection in a manner well known to those skilled in the art to form casing stand CS. The kickers 34 then move casing stand CS to racks 24.

It will be understood that the exact configuration of kickers, indexers, wrenches and tongs shown in FIGS. 5-7 may vary. The system may include additional operational components, e.g, electronics, hydraulics, power lines, etc. which are well known to those skilled in the art, but not depicted herein.

Figure 8:
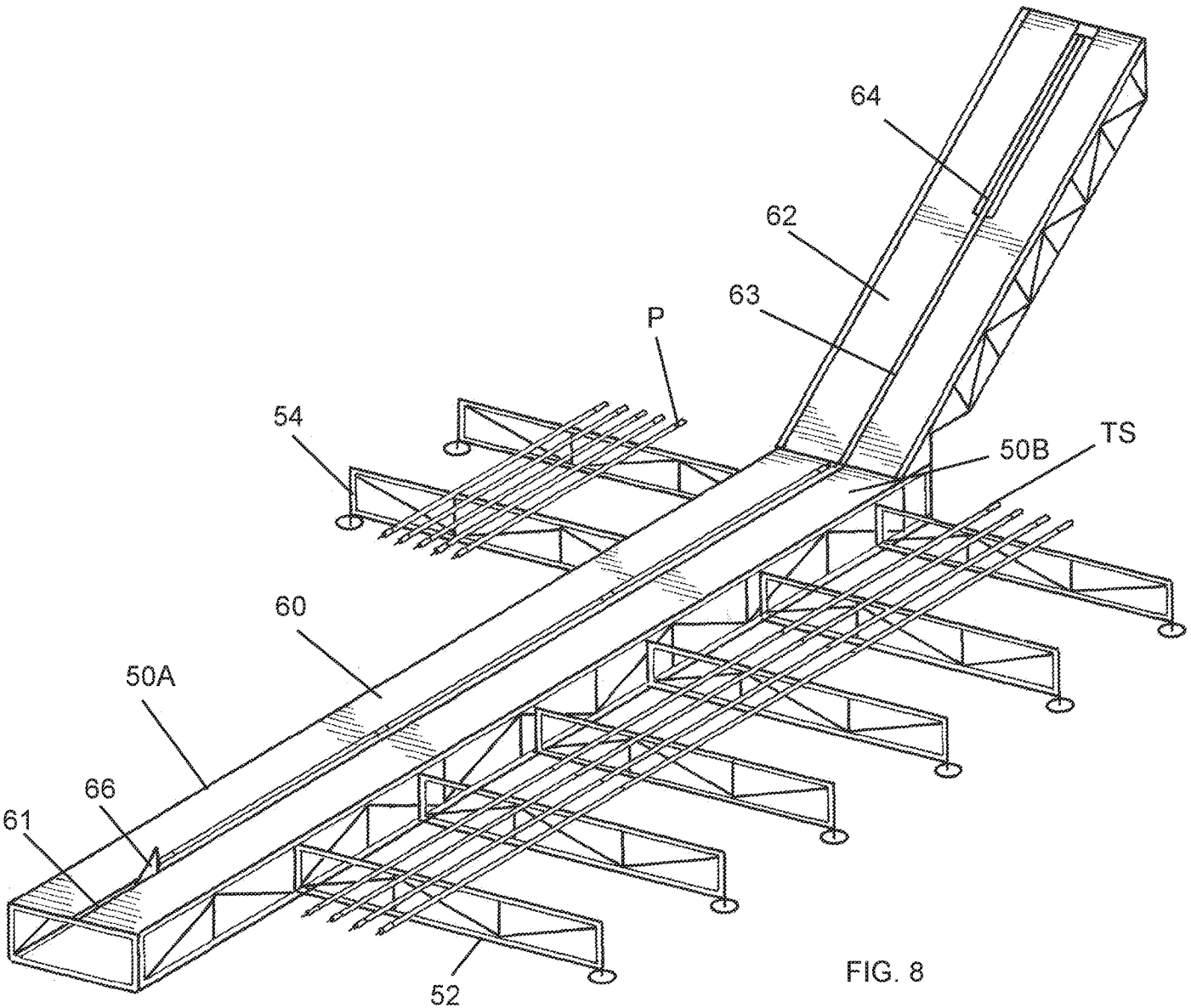
FIGS. 8, 9, and 9A depict using the catwalk to move a triple stand of drill pipe to the rig floor.

Turning to FIG. 8, there is shown one embodiment of catwalk 50. Catwalk 50 is able to trip single, double, and triple pipe stands, as well as casing stands. As shown in FIG. 8, there are positioned along the catwalk rack 52 for triple pipe stands TS or casing stands CS, and rack 54 for single pieces of pipe P. Although not shown, catwalk 50 can also trip double stands of pipe, should there be such a need. Once again, catwalk 50 is made up of two skids 50A and 50B for ease of transport. Catwalk 50 is comprised of the catwalk floor 60, V-door 62, and carrier 64. Catwalk floor 60 has an elongate opening 61 down the center. Similarly, V-door 62 has an elongate opening 63 along the center. A skate 66 extends through opening 61 and is connected to a drive chain system (see FIGS. 13-15) below catwalk floor 60. Skate 66 pushes the tubular along the catwalk floor 60, up the V-door 62 to the rig floor at which point an elevator (not shown) grabs the end of the pipe and pulls it up.

Figures 9, 9A:
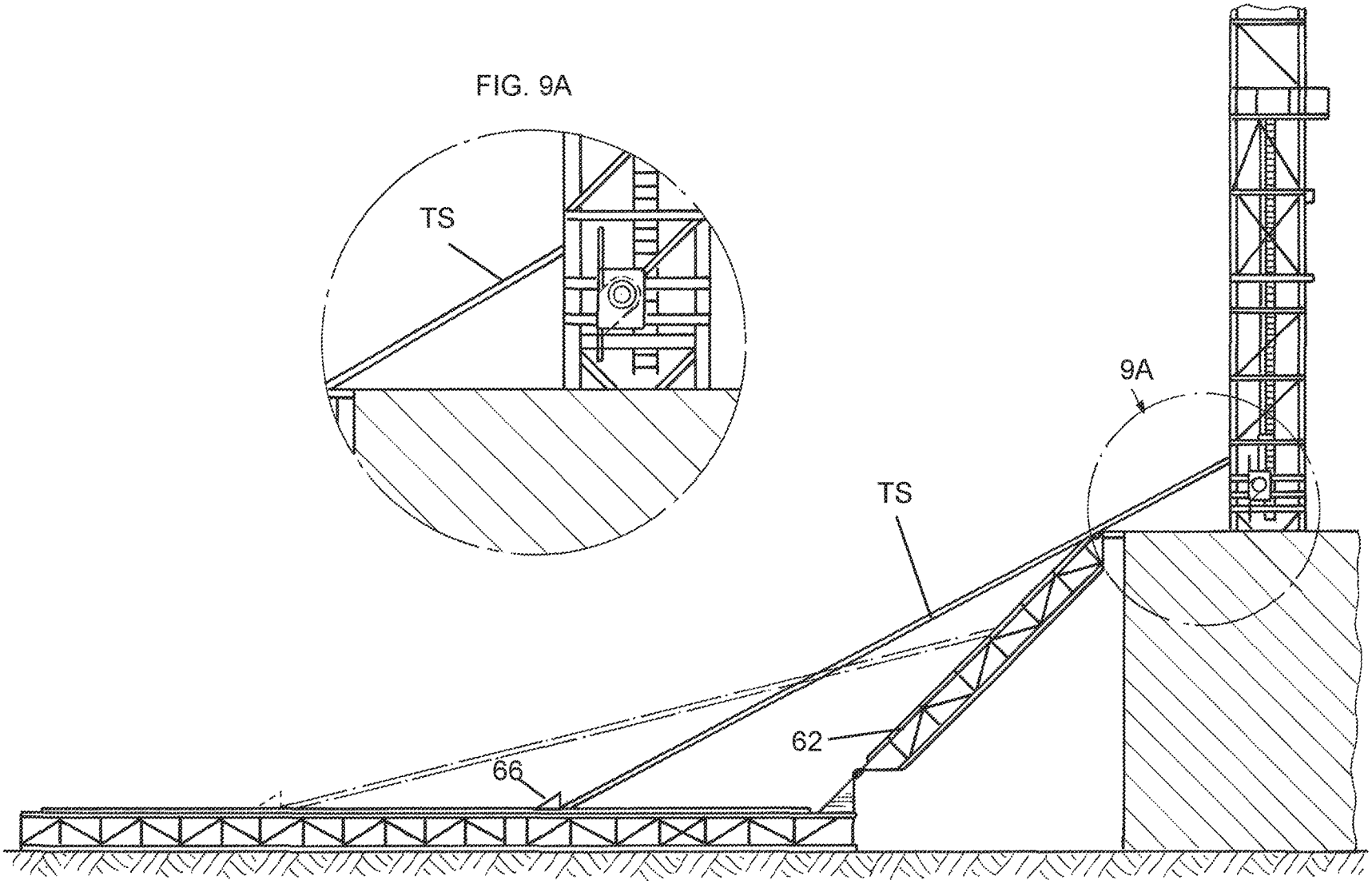
Figure 10:
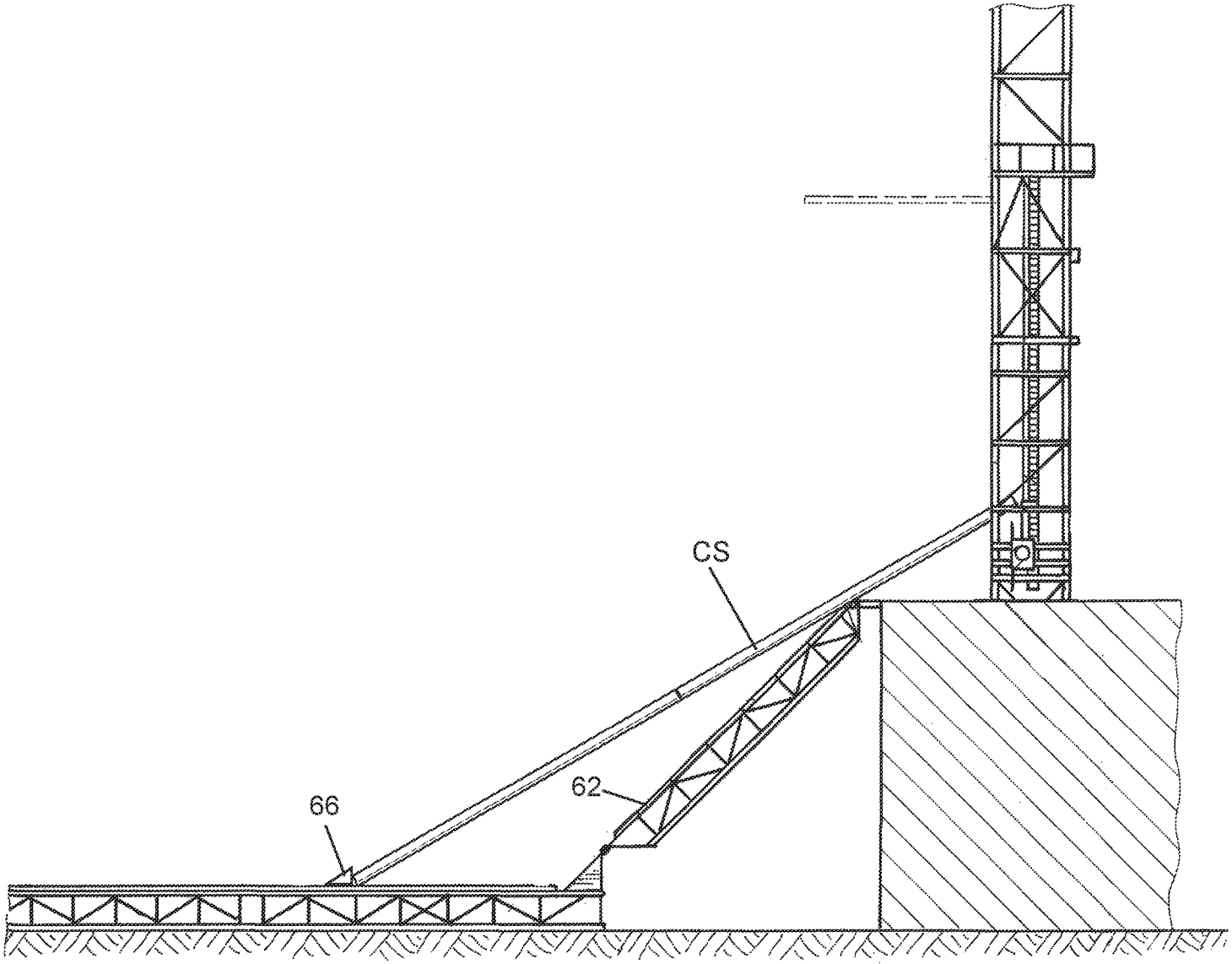
FIG. 10 depicts using the catwalk to move a stand of casing to the rig floor.

FIGS. 9 and 9A show a triple stand TS being moved along the catwalk floor 60 and up the V-door 62. Depending on the nature of the rig, if needed skate 66 can travel up the V-door 62 as well to push triple stand TS into position.

Figure 11:
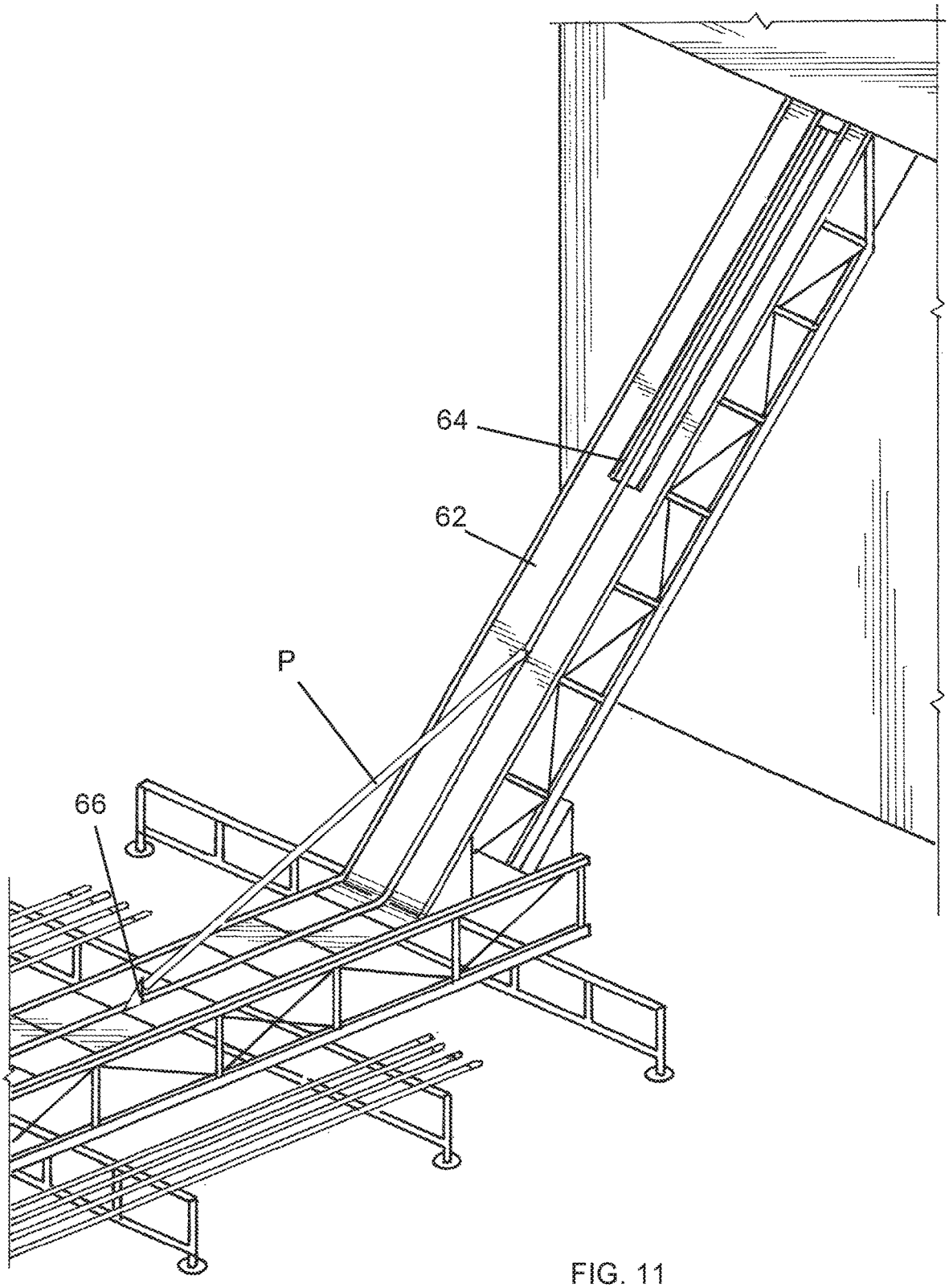
FIGS. 11-12 depict using the catwalk and v-door to move a single stand of drill pipe to the rig floor.
Figure 12:
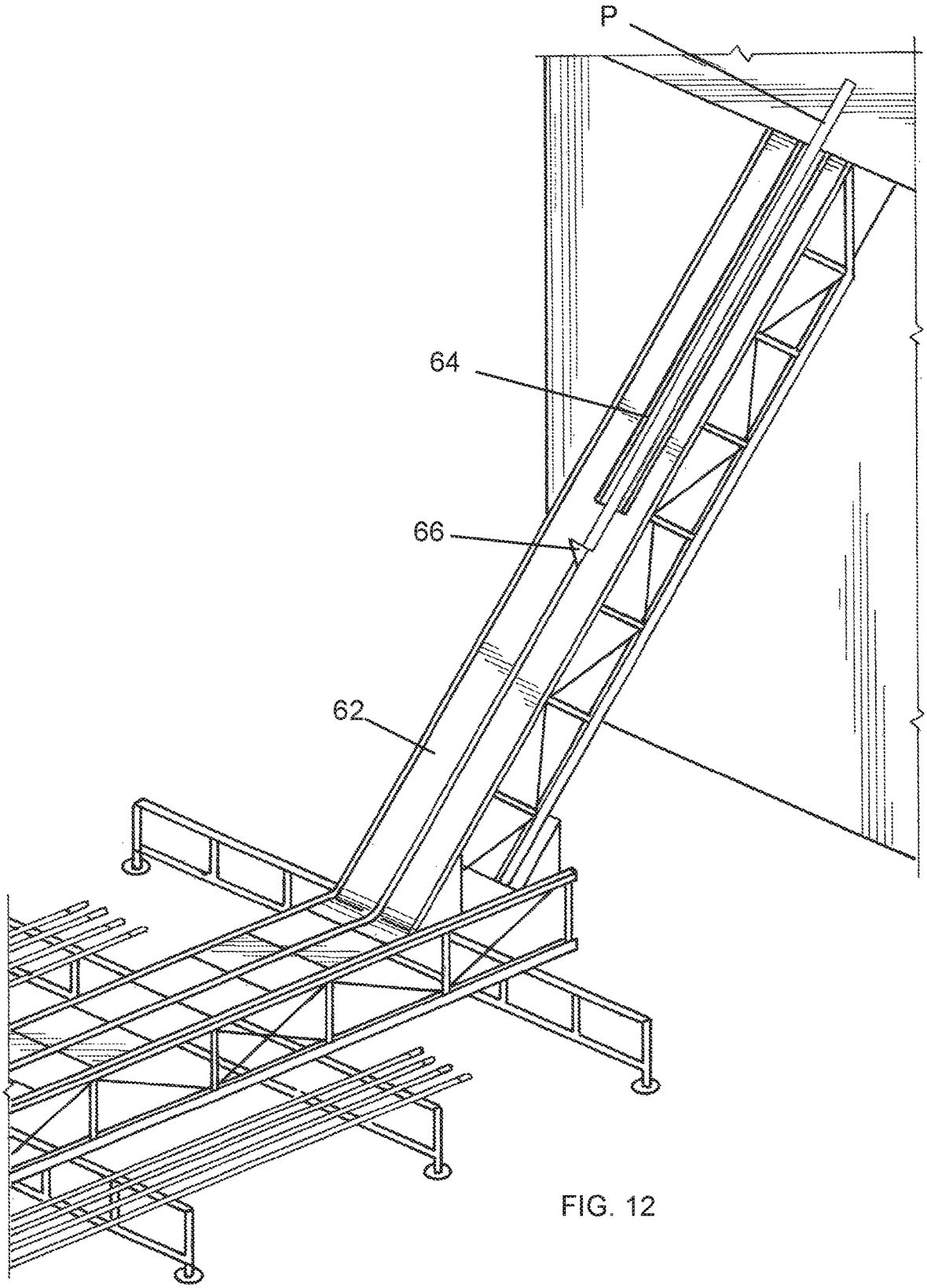

FIG. 11 show a casing stand CS being moved along the catwalk floor 60 and the V-door 62. Once again, if needed, skate 66 can travel up the V-door 62 as well to push casing stand CS into position.

Figure 13:
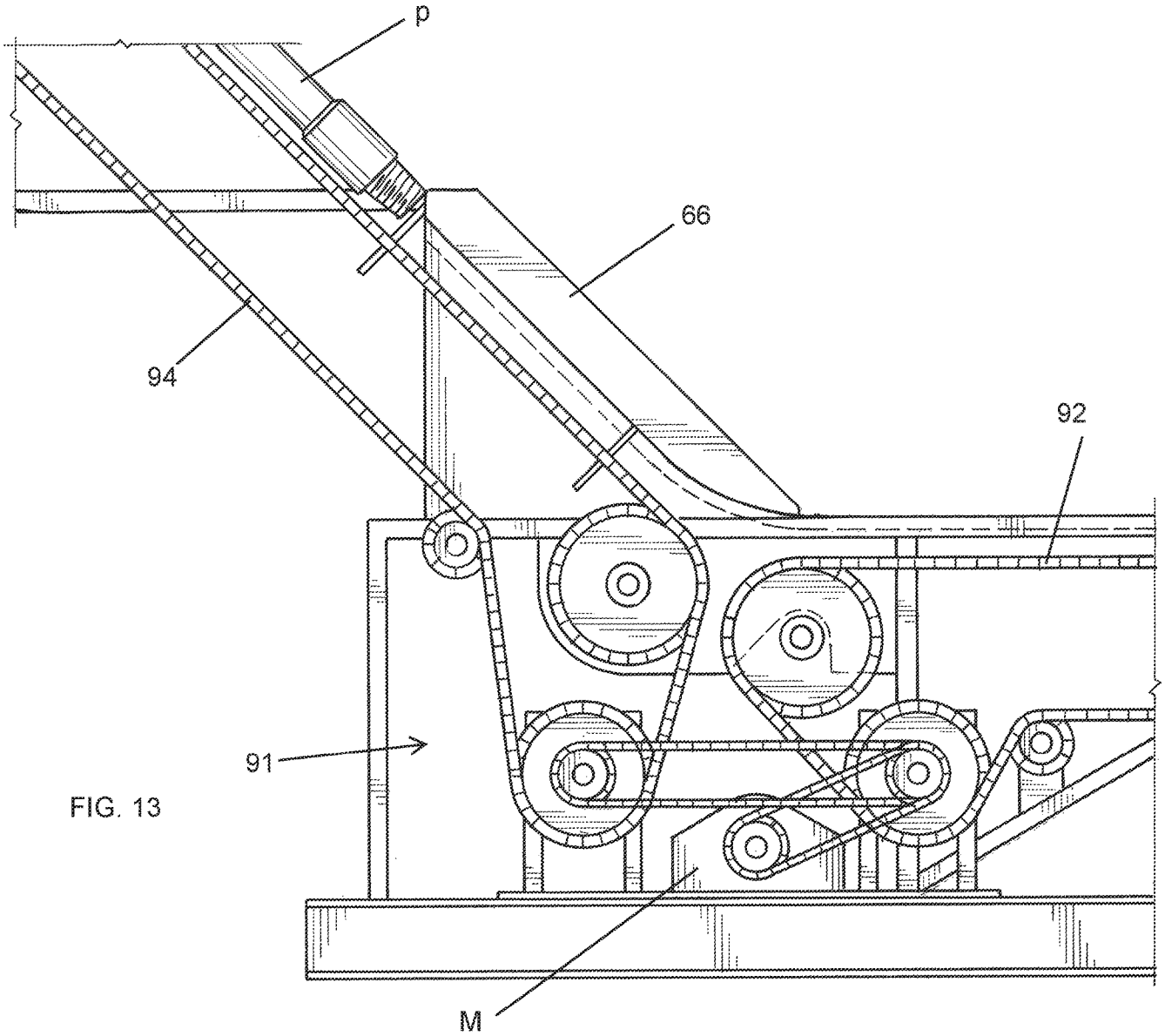
FIG. 13 is a cross-sectional depiction of the chain drive of one embodiment of the skate of the present invention.
Figure 14:
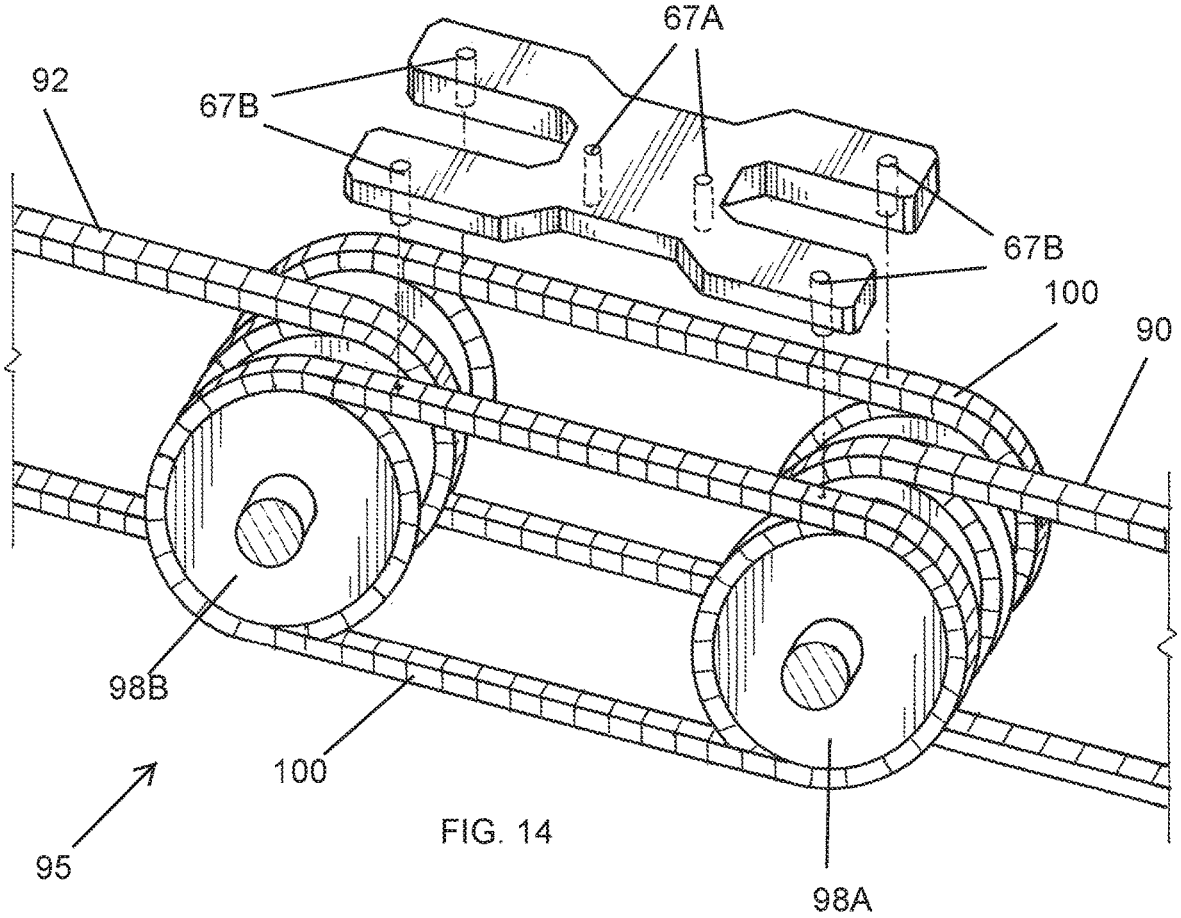
FIGS. 14-15 depicts one embodiment of a transition system for a chain drive of the present invention.
Figure 15:
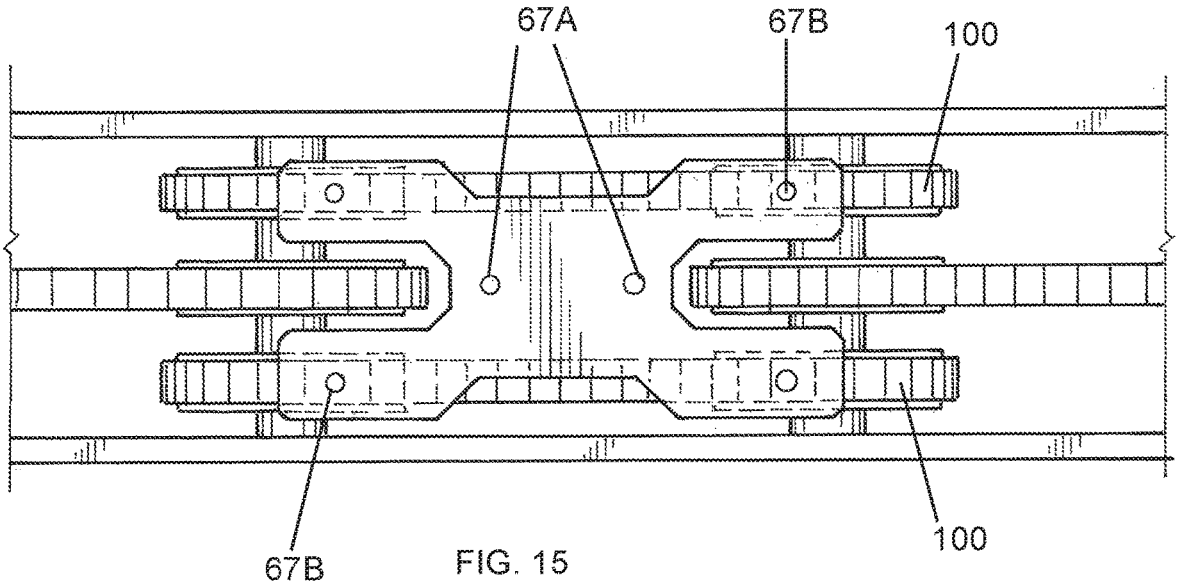

Turning to FIGS. 11-17, there is shown a single piece of pipe being moved along the catwalk floor 60 and up the V-door 62. Skate 66 travels along both catwalk floor 60 and V-door 62. FIG. 13 shows one embodiment of the chain drive 91 and the drive chains 92 and 94 which run under catwalk floor 60 and under V-door 62, respectively. Motor M is operative to power both chains 92 and 94. It will be appreciated that the gearing configuration shown in FIG. 13 is only one embodiment for powering the drive chains. There are many configurations which would be well understood to those of skill in the art. Chains 92 and 94 could be driven by separate motors, but it is preferred that they are driven by one to ensure they move at the same speed. FIGS. 14 and 15 show one embodiment of a transition point which allows skate 66 to transfer from one chain to another. FIGS. 14 and 15 show the transition assembly 95 positioned between two skids. A similar system can be positioned at the transition from the catwalk skid to the V-door. Transition assembly 95 is comprised of gear assemblies 98A and 98B each of which comprise three sets of rotatable toothed gears. A pair of transition chains 100 engage the laterally outermost gears of both gear assemblies 98A and 98B. Chain 90 of skid 50A engages the inner gears of gear assembly 98A. Chain 92 of the skid 50B engages the inner gears of gear assembly 98B. It will be appreciated that the inner gears can rotate in the opposite direction of the outer gears of gear assemblies 98A and 98B. Skate 66 extends through opening 61 in catwalk floor 60, and opening 63 of V-door 62. The upper part of skate 66 engages the tubular being pushed, while the lower part of skate 66 engages the drive chains. Skate 66 has a series of laterally inwardly positioned teeth 67A and a plurality of series of laterally outwardly positioned teeth 67B. As skate 66 moves along the catwalk on skid 50A, teeth 67A engage chain 90. When transitioning between skids, teeth 67B engage transition chains 100. Skid 66 continues to move toward skid 50B. Teeth 67A will no longer engage chain 90 but will eventually engage chain 92. As skid 66 continues moving past the transition point, teeth 67B become disengaged from chains 100. When returning to skid 50A, the same process occurs in reverse. Teeth 67B will engage transition chains 100 which will allow skid 66 to smoothly transition from chain 92 back to chain 90. Thus, when the catwalk is comprised of two skids, skate 66 is able to transfer from the chain of one skid to the chain of the other skid. It will be readily appreciated that this is one way of accomplishing a smooth transition of skate 66 from one chain to another. A similar system may be used with only one gear assembly and a set of laterally inner chains and laterally outer chains. Skate 66 could transition between the laterally inner and outer chains by means of the laterally inner and outer teeth 67A and 67B, respectively. Such a configuration would eliminate the need for a separate transition chain.

Figure 17:
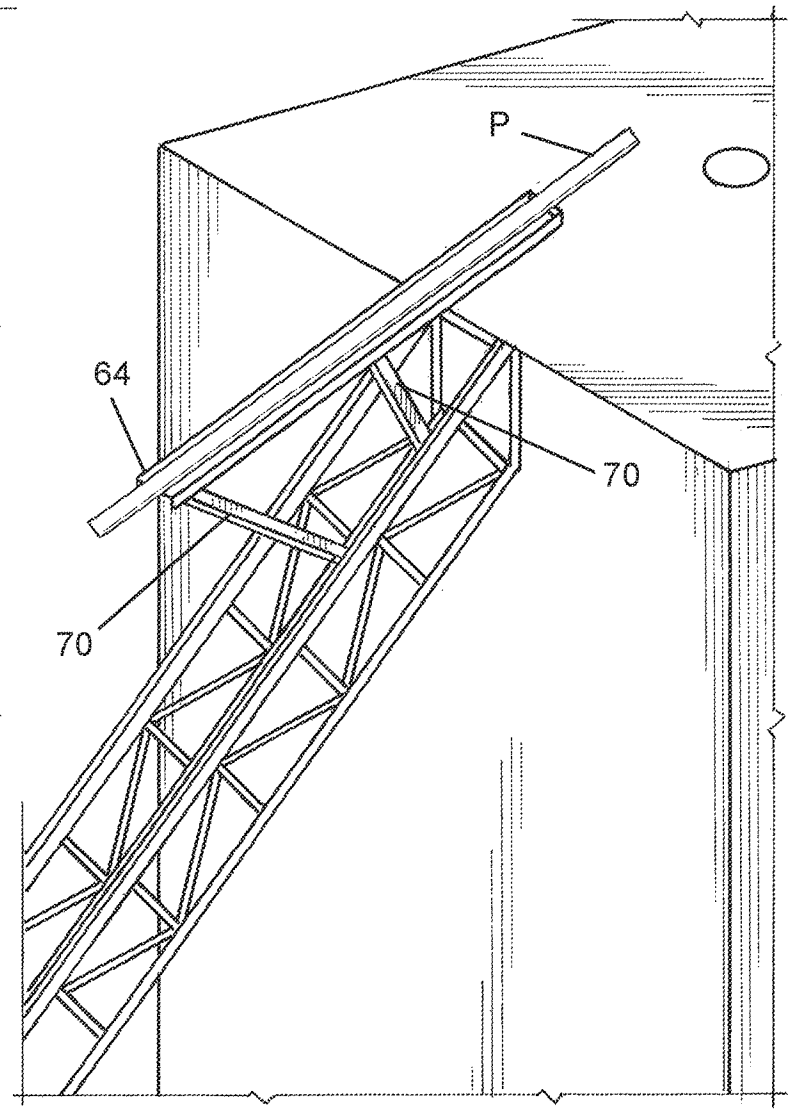
FIGS. 16-17 depict transferring a single stand of drill pipe to the rig floor.
Figure 16:
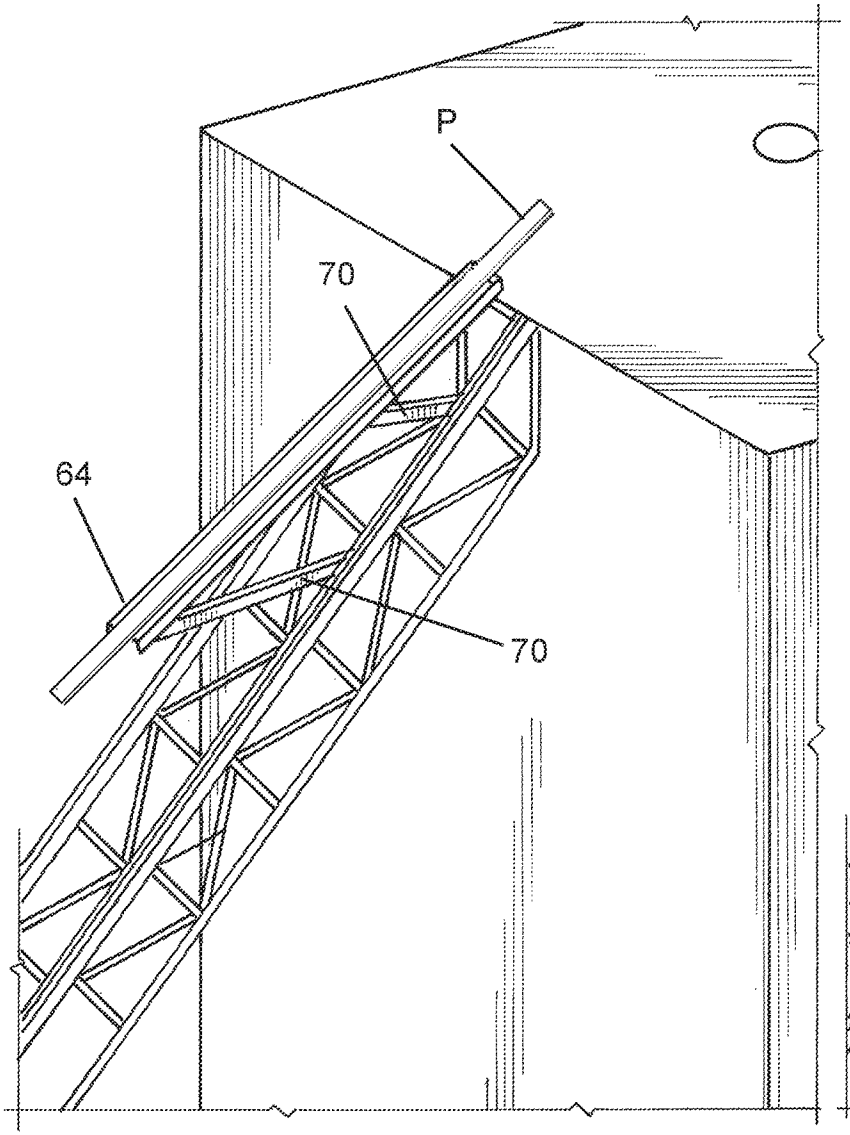

Turning to FIGS. 16 and 17, there is shown skate 66 guiding the relatively short single piece of pipe P up V-door 62 until it is engaged by carrier 64. Carrier 64 grips pipe P and lifts it into position by legs 70 for the elevator (not shown) to grip. Legs 70 can be powered by hydraulics, pneumatics, electronics, or other ways well known to those skilled in the art.

Figure 18:
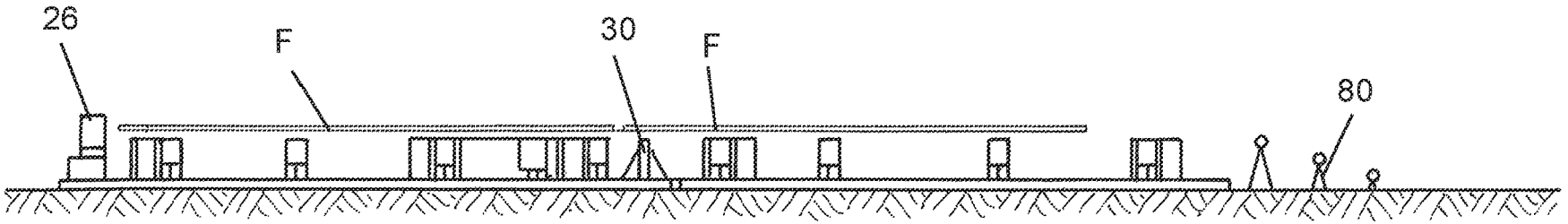
FIGS. 18-19 depict the building of a flare line using the horizontal stand builder of the present invention.
Figure 19:
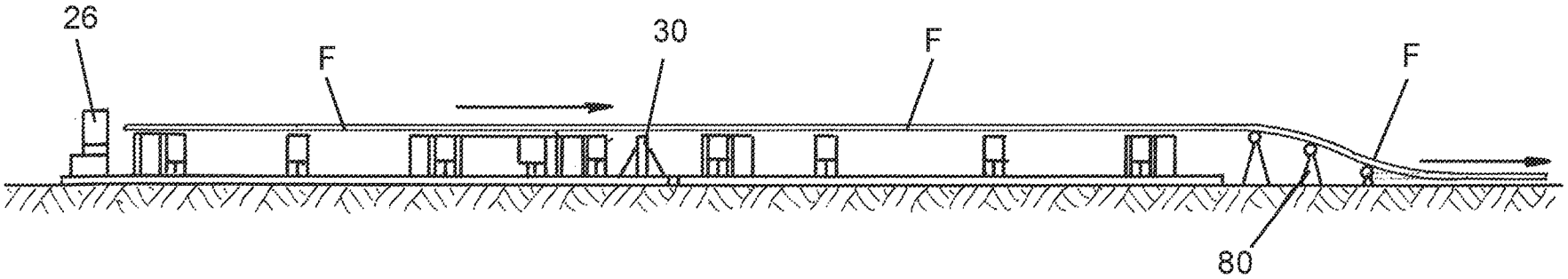

FIGS. 18 and 19 show another use of the stand builder of the present invention. Stand builder 20 can be used to build flare lines F. The casing power tongs 26 and casing tongs 30 are used to connect the flare line segments F. The assembled flare line F can then be eased onto ground level with pipe roller stands 80.

The stand builder and catwalk of the present invention provides several advantages. The system allows the horizontal building of pipe stands or casing stands. This reduces the risk of injuries to workers who typically build such stands on the rig floor. The catwalk is able to transfer the long triple stands and casing stands to the rig floor but is also capable of moving shorter single pieces of pipe.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A method for horizontally building tubular stands and for transferring single, double, or triple tubular stands to a rig, said method comprising:

providing a catwalk having a catwalk floor, and a V-door, both positioned alongside a rig;

providing a carrier, disposed at an upper end of said V-door and operable to lift a single stand of tubular from said V-door;

providing a skate disposed on said catwalk floor and operable to travel along said catwalk floor and up said V-door;

providing a horizontal stand builder disposed alongside said catwalk and comprising at least one powered wrench operable to connect stands of tubular to one another;

in the case of transferring a single tubular stand:

transferring said single tubular stand from a rack to said catwalk;

advancing said skate to push said single tubular stand along said catwalk floor, up said V-door, and into said carrier;

said carrier gripping and lifting said sing tubular stand into position for an elevator on said rig to grip said single tubular stand and transfer said single tubular stand to said rig;

in the case of building and transferring a double tubular stand:

transferring first and second single tubular stands from respective first and second racks to said stand builder;

connecting said first and second tubular stands with said powered wrench to form a double stand;

transferring said double stand to said catwalk;

advancing said skate to push said double stand along said catwalk floor, up said V-door, and into position for an elevator on said rig to grip said double stand and transfer said double stand to said rig;

in the case of building and transferring a triple tubular stand:

transferring first and second single tubular stands from respective first and second racks to said stand builder;

connecting said first and second tubular stands with said powered wrench to form a double stand;

moving said double stand forward along said stand builder using at least one set of powered rollers;

transferring a third tubular stand from said first rack to said stand builder in position behind said double stand;

connecting said third single tubular stand to said double stand with said powered wrench to form a triple stand;

transferring said triple stand to said catwalk;

advancing said skate to push said triple stand along said catwalk floor, up said V-door, and into position for an elevator on said rig to grip said triple stand and transfer said triple stand to said rig.

2. The method of claim 1, wherein said single tubular stands comprise drill pipe or casing.

3. The method of claim 2, wherein said stand builder further comprises a casing tongs for connecting single tubular stands of casing.

4. The method of claim 3, wherein said tubular stands comprise segments of flare line, and wherein said casing tongs connect said segments of flare line to form an assembled flare line.

5. The method of claim 4, wherein said assembled flare line is eased onto the ground with at least one pipe roller stand.

6. The method of claim 1, further comprising the steps of:

in the case of building and transferring a double tubular stand:

transferring said double stand to a rack before transferring said double stand to said catwalk; and in the case of building and transferring a triple tubular stand:

transferring said triple stand to a rack before transferring said triple stand to said catwalk;

transferring said triple stand to a rack before transferring said triple stand to said catwalk.

7. The method of claim 1, wherein said stand builder is comprised of two skids.

8. The method of claim 1, wherein said skate is operated by a chain drive system comprising at least one chain disposed beneath said catwalk floor and said V-door, said skate being releasably connected to said chain.

9. The method of claim 1, wherein said skate extends through an elongate opening in said catwalk floor, and said skate comprises teeth which engage said at least one chain such that as said chain moves, said skate is driven along said catwalk floor.

10. A system for horizontally building tubular stands and for transferring single, double, or triple tubular stands to a rig, said system comprising:

a catwalk having a horizontal catwalk floor, and a V-door, both positioned alongside a rig;

a horizontal stand builder disposed alongside said catwalk and comprising:

at least one powered wrench operable to connect tubular stands to one another to form double or triple tubular stands;

at least one set of rollers for moving said tubular stands along said stand builder;

at least one kicker for moving said double or triple tubular stands from said stand builder to said catwalk floor;

a skate disposed on said catwalk floor and operable to travel along said horizontal catwalk floor and up said V-door, said skate being operable to push single, double, or triple tubular stands along said catwalk floor and up said V-door to a position whereby an elevator on said rig can grip said single, double, or triple tubular stand and transfer it to said rig, wherein said skate is operated by a chain drive system comprising a first chain disposed beneath said catwalk floor and a second chain disposed beneath said V-door, said skate being operative to transition from engaging said first chain to engaging said second chain.

11. The system of claim 10, further comprising: a carrier disposed at an upper end of said V-door and operable to lift a single stand of tubular from said V-door to a position whereby an elevator on said rig can grip said single tubular stand and transfer said single tubular stand to said rig.

12. The system of claim 10, wherein said single tubular stands comprise drill pipe or casing.

13. The system of claim 12, wherein said stand builder further comprises casing tongs for connecting single tubular stands of casing to form double stands of casing.

14. The system of claim 10, further comprising:

at least one rack positioned between said stand builder and said catwalk for storing double or triple tubular stands before transferring them to said catwalk.

15. The system of claim 10, wherein said stand builder is comprised of two skids.

16. The system of claim 10, wherein said skate is operated by a chain drive system comprising at least one chain disposed beneath said catwalk floor and said V-door, said skate being operatively connected to said chain.

17. The system of claim 16, wherein said skate extends through an elongate opening in said catwalk floor, and said skate comprises teeth which engage said at least one chain such that as said chain moves, said skate is driven along said catwalk floor.

18. The system of claim 10, further comprising a transition chain assembly disposed between said first and second chains, whereby said skate operatively connects to said transition chain assembly when transitioning from said first chain to said second chain.

19. A method for transferring single, double, or triple tubular stands to a rig, said method comprising:

providing a catwalk having a horizontal catwalk floor, and a V-door, both positioned alongside a rig;

providing a carrier, disposed at an upper end of said V-door and operable to lift a single stand of tubular from said V-door;

providing a skate disposed on said catwalk floor and operable to travel along said horizontal catwalk floor and up said V-door, providing a chain drive system for driving said skate, said chain drive system comprising a first chain disposed beneath said catwalk floor and a second chain disposed beneath said V-door, said skate being operative to transition from engaging said first chain to engaging said second chain; and performing (A) or (B) or (C) or any combination thereof, wherein (A), (B), and (C) each respectively comprise:

(A) in the case of transferring a single tubular stand:

transferring said single tubular stand to said catwalk;

advancing said skate to push said single tubular stand along said catwalk floor, up said V-door, and into said carrier;

said carrier gripping and lifting said sing tubular stand into position for an elevator on said rig to grip said single tubular stand and transfer said single tubular stand to said rig;

(B) in the case of transferring a double tubular stand:

transferring said double stand to said catwalk;

advancing said skate to push said double stand along said catwalk floor, up said V-door, and into position for an elevator on said rig to grip said double stand and transfer said double stand to said rig;

(C) in the case of transferring a triple tubular stand:

transferring said triple stand to said catwalk;

advancing said skate to push said triple stand along said catwalk floor, up said V-door, and into position for an elevator on said rig to grip said triple stand and transfer said triple stand to said rig.

* * * * *